US005402951A

United States Patent [19]

Hermanns et al.

[11] Patent Number: 5,402,951

[45] Date of Patent: Apr. 4, 1995

[54] TEXTILE WINDING MACHINE WITH A TUBE SUPPORT MEMBER TRANSPORT SYSTEM

[75] Inventors: Ferdinand-Josef Hermanns, Erkelenz; Juergen Breuer, Viersen; Franz-Josef Flamm, Stolberg, all of Germany

[73] Assignee: W. Schlafhorst AG & Co., Monchen-Gladbach, Germany

[21] Appl. No.: 34,236

[22] Filed: Mar. 22, 1993

[30] Foreign Application Priority Data

Mar. 21, 1993 [DE] Germany ..... 42 09 219.1

[51] Int. Cl.[6] ..... B65H 67/02; B65H 67/06

[52] U.S. Cl. ..... 242/35.50 A; 57/264; 57/281; 242/18 R; 242/35.5 R

[58] Field of Search ..... 242/35.5 A, 35.5 R, 242/36, 18 R; 57/281, 264, 265

[56] References Cited

U.S. PATENT DOCUMENTS

| | | | |
|---|---|---|---|
| 4,544,107 | 10/1985 | Matsui et al. | 242/35.5 A |
| 4,856,723 | 8/1989 | Tone | 242/35.5 A X |
| 5,003,762 | 4/1991 | Seaglia | 242/35.5 A X |
| 5,056,725 | 10/1991 | Wirtz et al. | 242/35.5 A |
| 5,078,329 | 1/1992 | Grecksch et al. | 242/35.5 A |
| 5,100,073 | 3/1992 | Moehrke et al. | 242/35.5 A X |
| 5,240,193 | 9/1993 | Backhaus | 242/35.5 A |
| 5,273,225 | 12/1993 | Backhaus | 242/35.5 A |

FOREIGN PATENT DOCUMENTS

| | | |
|---|---|---|
| 3344473A1 | 6/1984 | Germany . |
| 32354402 | 5/1985 | Germany . |
| 3603002A1 | 8/1986 | Germany . |
| 3732367A1 | 11/1988 | Germany . |
| 3843554A1 | 6/1990 | Germany . |
| 3911799A1 | 10/1990 | Germany . |
| 3912030A1 | 10/1990 | Germany . |
| 4005548A1 | 8/1991 | Germany . |
| 4034824A1 | 5/1992 | Germany . |

*Primary Examiner*—Daniel P. Stodola
*Assistant Examiner*—William Stryjewski
*Attorney, Agent, or Firm*—Shefte, Pinckney & Sawyer

[57] ABSTRACT

A textile winding machine having a transport system for recirculating bobbin tube support members carrying empty bobbins, and diverting tube support members carrying partially unwound bobbins, and tubes having remnant windings of yarn thereon into diverting paths is disclosed. Each bobbin has an information transfer device which contains data pertaining to the bobbin tube on which it is carried. At least one reading device is present in the transport system for reading the information transfer device. The transport system comprises a storage path for storing tube support members; a device for diverting tube support members; and a control unit connected to the reading device for controlling the diverting device to divert tube support members which tube support members are determined by the control unit in conjunction with the reading device to the storage path to have predetermined storage path conditions. The transport system may also include a delivery path and an ancillary transport path extending between the return path and the delivery path for transport of tube support members therebetween. A counting device may be included and coupled to the memory device for writing bobbin data on the associated tube support member and may be disposed in an area for transferring bobbins to tube support members.

8 Claims, 1 Drawing Sheet

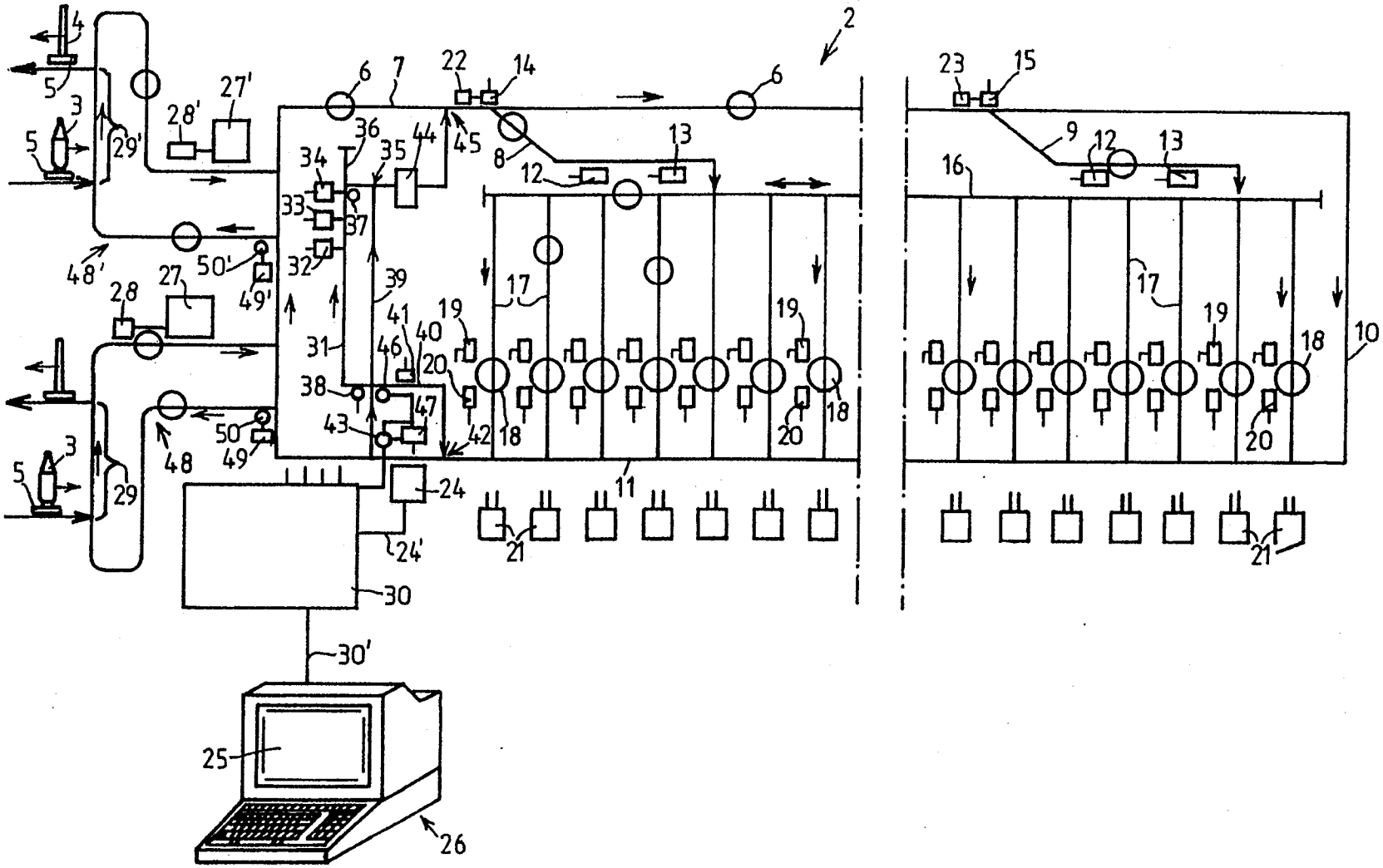

TEXTILE WINDING MACHINE WITH A TUBE SUPPORT MEMBER TRANSPORT SYSTEM

FIELD OF THE INVENTION

The invention relates to a textile winding machine and more particularly to a transport system for recirculating tube support members in a textile winding machine.

BACKGROUND OF THE INVENTION

In automatic textile winders operating in conjunction with automatic spinning machines, it is important to be able to automatically monitor the condition of the bobbin tubes as they are recirculated to determine defects in the performance of the machine and identify the particular station at which defects occur.

German Patent Disclosure DE 39 11 799 A1 discloses a transport system for bobbin tube support members in a textile winder, the tube support members having posts for transporting bobbins on tubes. These tube support members each have an information transfer means incorporating data pertaining to the bobbins or bobbin tubes. This may, for instance, involve data providing information identifying which station of a spinning machine has produced a given bobbin. In this way, it can be determined which spinning station is malfunctioning, e.g., is producing bobbins with deficiencies in quality. This same prior disclosure also describes furnishing the information on the yarn batch.

This prior disclosure, however, cannot remove tube transport support members carrying defective bobbins and therefore requires human intervention to remove bobbins to prevent system malfunction. If a bobbin cannot be prepared with the automatic preparing means of the machine, or in other words if the yarn end cannot be pre-placed properly to be engaged by yarn receiving devices at a textile winding station, then such a bobbin may recirculate continuously on its tube support member in the closed transport system. Particularly when a batch is being processed in which this defect occurs multiple times, such constantly recirculating defective bobbins unnecessarily reduce the capacity of the winder and thus lower the output of the textile winder. A textile winding machine which provides for the removal of defective bobbins without human intervention is, therefore, desired.

SUMMARY OF THE INVENTION

The object of the invention is to enable improved monitoring of the transport units in closed transport systems of textile winders.

This and other objects of the present invention are accomplished by a textile winding machine having a transport system for recirculating bobbin tube support members carrying empty bobbins, and diverting tube support members carrying partially unwound bobbins, and tubes having remnant windings of yarn thereon into diverting paths. Each bobbin has an information transfer device carried thereon which contains data pertaining to the bobbin tube on which it is carried, wherein at least one reading device is present in the transport system for reading the information transfer device. The transport system comprises a storage path for storing tube support members carrying bobbin tubes; means for diverting tube support members to the bobbin storage path; and a control unit connected to the reading device for controlling the diverting device to divert tube support members carrying bobbins which tube support members or bobbins carried thereon are determined by said control unit in conjunction with the reading device to the storage path to have predetermined storage path conditions.

The transport system may also include a delivery path for delivering tube support members to the winding stations of the winding machines and a return path for returning tube support members from the winding stations, an ancillary transport path extending between said return path and the delivery path for transport of tube support members therebetween. The control device may have a counting device for ascertaining multiple returns of the same tube support member. The counting device has a limit switch that is adjustable to a predetermined number of the multiple returns.

The information transfer device may comprise a memory chip and a memory means coupled contactlessly to the chip by an associated antenna and may further comprise a counting device coupled to the memory device for writing bobbin data on the associated tube support member. The counting device may be disposed in an area for transferring bobbins to tube support members.

The control unit may actuate the control of the diverting device in response to the inability to detect data of an information transfer device.

The textile winding machine of the present invention may further comprise winding sections of the winder for processing different batches of bobbins having yarn weights differing from one another; at least one electronic yarn clearer, coupled to at least one winding station computer in the vicinity of the winding station having adjustable tolerance ranges for the correct yarn weight for a given batch; a threshold value switch on each of the at least one winding station computers that can be activated if a tolerance is exceeded and which causes the immediate stoppage of the winding station; and a writing device in each winding station for recording as an abnormality in the information transfer device of the bobbin the exceeding of the tolerance range by the yarn weight of the bobbin.

The at least one winding station computer may be connected to a memory containing the tolerance ranges of the other batches prepared on the textile winder, in the form of data in memory for transmission to the writing device for writing the appropriate batch into the information transfer device of the tube support member; and wherein the writing device is a read/write memory device for monitoring the storage in memory of the batch data and to record any inability to accomplish the writing.

The textile winder may be subdivided into winding sections for processing different batches with yarn weights differing from one another and may further comprise branch paths branching from a common delivery path to the winding stations; at least one diverter located in the vicinity of the beginning of the branch paths and each diverter being coupled to one second reading device for delivering the bobbins in correct batches; and a bypass path branching from the delivery path for transporting tube support members having information transfer device which are not legible by second reading device.

The textile winding machine of the present invention may further comprise a third reading device coupled to a display device, said third reading device being disposed at said storage path for determining the type of defect of the tube support members or bobbins in the storage path.

The invention will be described below in further detail in terms of an exemplary embodiment, in conjunction with the drawing.

BRIEF DESCRIPTION OF THE DRAWINGS

The single FIGURE is a schematic view of the transport system of the textile winder of the present invention.

DESCRIPTION OF THE PREFERRED EMBODIMENT

The transport system of the preferred embodiment of the present invention recirculates tube support members 6 to, through, and from winding stations 18 of a textile winder 2. Two transfer loops 48,48' connect the transport system to two spinning machines (not shown). From the spinning machines, bobbins 3 are delivered on bobbin tube support members 5 to respective exchange paths 29,29'. Along these exchange paths 29,29', which are common to the transfer loops 48,48', tube support members 5 of the spinning machines are transported in association with tube support members 6 of the winder with the bobbins 3 on tubes 4 being transferred therealong from the tube support members 5 of the spinning machine to the tube support members 6 of the winder, and empty tubes 4 being transferred from the tube support members 6 of the winder to tube support members 5 of the spinning machine. At the end of the exchange paths 29,29', the tube support members 5 of both spinning machine circuits with the empty tubes 4 return to the respective ring spinning machines for winding of yarn thereon at the spinning stations.

The tube support members 6 of the winder circuit, carrying empty tubes 4, travel along the transfer loops 48,48' to and through the respective exchange paths 29,29', at which the empty tubes are exchanged for tubes with full bobbins thereon, which are then conveyed to the main transport system. Since such exchange operation is conventional and has been described with all the equipment necessary to perform the exchange in, for example, German Patent Application DE 40 34 824 A1, no detailed description is necessary.

Diverters 50,50' are disposed at the entrances of the transfer loops 48, 48' and can be actuated by upstream reading devices 49, 49'. These reading devices 49, 49' make it possible to identify the batch of the arriving tube support member 6 at a given time, and by the coupled diverters 50, 50', they effect the diverting of tubes to the ring spinning machine that is producing the batch with which the tube has been associated. Batches of bobbins may differ by such parameters as yarn weight.

Downstream of the exchange paths 29,29', counting devices 28, 28' are provided, which have sensors (not shown) that ascertain the passage therepast of bobbins 3 on tube support members 6 and increment the counting devices 28, 28'. Since the bobbins 3 move past the sensors of the counting devices in the same order as that in which they were doffed from the spinning stations of the spinning machines, the result of counting matches the appropriate spinning station of the spinning machine. Naturally, once the bobbins 3 have all been transferred to the winder 2, it is necessary to reset the applicable counting device to zero, so that then after the doffing, the match between the counting result and the number of the spinning station will be assured, beginning again at 1. The counting devices 28,28' are coupled to writing devices 27,27', which write the counting result, corresponding to the number of the spinning stations, on the associated tube support member 6. At the same time, the writing devices are intended to erase the information on the respective tube support member that refers to the bobbin 3 transported on it previously. Accordingly, the tube support member 6 leaves the corresponding writing station carrying only the information of the number of the spinning station that produced the bobbin 3 newly placed on it, and the batch identification.

The further transport of the tube support members 6 with full bobbins 3 takes place over a delivery path 7 and diverging paths 8,9 to a distribution path 16. Controlled diverters 14 and 15 are disposed at the beginning of the diverging paths 8,9 and assure that the tube support members 6 with bobbins 3 will be distributed with the appropriate batches to the two diverging paths 8,9. Upstream of the diverters 14,15, there are reading devices 22,23, which read the batch identification on the information carrier of the particular tube support members being moved past them and position the adjacent diverter accordingly. The delivery path 7 extending onward beyond the divergence of the diverging path 9 then merges with a bypass path 10, which feeds into the beginning of a tube return path 11. This bypass path 10 is intended to prevent tube support members 6 that cannot be associated with a batch by either the reading device 22 or the reading device 23 from being delivered to any winding section. Those tube support members 6 then later reach a reading means 24 such as a read-only (ROM) or read/write memory at the end of the tube return path 11, which detects the nonlegibility of the batch identification and diverts them to a bobbin storage path 31.

Bobbin preparation units 12,13 are disposed at the diverging paths 8,9. Once again, this type of an assembly is conventional. It is long known for bobbins to be prepared in several stages by units connected one after another (see, for example, German Patent Disclosure DE 39 19 526 A1).

The distribution path 16 adjoining the diverging paths 8,9 has a conveyor belt driven reciprocally for delivery of tube support members 6 with the bobbins 3 to the various winding stations 2 in such a way that supply positions of crosswise transport paths 17 are refilled constantly. This distribution principle is known and described in German Patent Disclosure DE 38 43 554 A1, for example.

In the case of subdivision into textile winding sections, in this case two sections, a barrier is disposed at the parting line between the two sections (this parting line is not shown here), along the distribution path 16. As a result of this barrier, the tube support members 6 which have been delivered to the winding section intended for them through the respective diverging paths 8,9 are retained in the appropriate section. This provision is known and likewise described in German Patent Disclosure DE 38 43 554 A1.

The crosswise transport paths 17 lead from the distribution path 16 through winding stations 18 to the aforementioned tube return path 11, which is common to all the winding stations. At this point, it should be noted that for the sake of simplicity, only individual tube support members 6 have been shown, while in actuality, there are normally two or three tube support members with bobbins 3 waiting along the crosswise transport paths 17 between the distribution path 16 and the winding positions 18.

Once the bobbins 3 have been unwound, the tube support members 6 with their tubes 4 leave the respective winding station 18 and are delivered along the return path 11 back to the associated transport transfer loop 48,48' for tube exchange along the exchange paths 29,29'.

A read/write type memory device 19 is disposed in each winding station. It reads the spinning station number written on the information transfer means of the applicable tube support members 6 by the writing device 27,27' and sends it to a computer 21 associated with the individual winding station. Appropriate line connections are merely suggested here, for the sake of simplicity. In each winding station, there is an electronic yarn clearer 20, which checks the yarn traveling through it to a cross-wound bobbin, not shown, which is conventional and therefore known to those of skill in the art. This electronic yarn clearer 20 may detect deviations in the thickness of the yarn as well as nips and slubs. However, it also may detect a deviation in the yarn weight from the standard for the batch to be processed, over a relatively long length of yarn. The evaluation over a relatively long length of yarn makes it possible to distinguish deviations caused by slubs or nips from defective settings or other defects at the spinning station from batch deviations. To enable making such a distinction, it is naturally necessary for the standard yarn weight for the batches to differ from one another to an extent sufficient for detection of the difference.

If the yarn weight deviation or batch deviation is detected, then the winding station at which the deviation is detected is stopped immediately, with the winding station computer 21 being programmed in such a way that a predetermined length of yarn is drawn from the bobbin, a bobbin change is made, and the end of the yarn from the newly delivered bobbin 3 is spliced to an end of the yarn from the bobbin, this end still originating from the bobbin that was rewound for the incorrectly delivered bobbin. In this way, even without human intervention, incorrect delivery can be overcome without sacrificing quality and without requiring intervention by the operator.

According to the invention, however, it is provided in this case that an identification in the information carrier of the appropriate tube support member 6 be provided by the read/write memory means present at the winding station. This identification is later recognized at the aforementioned reading device 24 at the end of the return path 11, which actuates delivery of this tube support member 6 with its bobbin 3 to the storage path 31.

Another feature, which still further limits the necessity of human intervention, comprises writing the correct batch into the information transfer means, which is done by the read/write memory device 19 at the individual winding station. Since in this case only two batches are being processed, then it suffices if the other batch is simply written in. As a result, the delivery to the correct batch can then be done afterward without action on the part of the operator. However, in order to assure that another delivery to the wrong batch will not occur in the event that the rewriting proved impossible, it may be provided that the modified, newly encoded batch identification be test-read as a check and, if unsuccessful rewriting is found, a defect signal is written into the information transfer means. This defect signal can then be detected again at the reading device 24 to effect transfer of the tube support member 6 to the storage path 31. If the rewriting is successful, naturally no defect signal is written into the information transfer means.

In the event that more than two batches are processed in the textile winder, then, if automatic rerouting to the appropriate batch is desired, the storage of the other batch data in memory in the winding station computers is also necessary. A comparison of the yarn weight ascertained by the yarn clearer with the stored data then readily shows the correct batch association, which can be written into the information transfer means of the tube support member 6 by the read/write device 19.

Ancillary transport paths are provided off the return path 11 upstream of the transfer loops 48,48' to which tube support members 6 that are not to be circulated directly to one of the transfer loops 48,48' are diverted. Such diverted tube support members are those carrying tubes which for some reason have not been completely unwound in the winding stations and have either a sufficient amount of yarn to be recirculated to the winding station (partially unwound bobbins) or have only a few remnant windings of yarn thereon and require stripping of the remnant windings before the tube should be transported to the transfer loops 48,48'. In this way, only completely empty tubes are recirculated to the spinning machines.

In order to make a decision for diverting the tube support members 6 at this point, a bobbin scanner 47 is provided, which is capable of distinguishing between empty tubes, tubes with sufficient yarn windings for recirculation and tubes with only remnant yarn thereon. This bobbin scanner 47 actuates diverters 43,46, with diverter 43 diverting tube support members 6 with sufficient yarn for recirculation to an ancillary transport path 39 having a yarn end preparation device 44 therein. This bobbin preparation device 44 is of a conventional type especially appropriate for finding yarn ends in yarn windings in the combination on the tubes being diverted to assure that the end of the yarn can be grasped in the winding station to initiate unwinding thereof. It must be assumed here that such bobbins are rejected at the winding stations only if the yarn end could not be engaged by the yarn guide devices at the winding station.

If the bobbin scanner 47 has detected a tube with remnant yarn thereon, the diverters 43,46 are actuated to transfer the tube support member to a branch path 40, along which a tube stripping device 41 is disposed. The tube support member 6, with the tube cleaned, then travels by a converging path 42 back onto the tube return path 11 upstream of the scanner 47, which now detects no remnant yarn and thereupon allows the tube support member with the now empty tube to be delivered to the appropriate transfer loop 48,48.

If the same spinning station number written on an information transfer means of a tube support member 6 has been detected to have yarn thereon repeatedly at relatively short time intervals by the reading device 24 that is connected by an information line 24' to a control unit 30, then this is assumed to be an indication that processing of the bobbin at a winding station is not possible, for whatever reasons. An appropriate limit value is therefore incorporated in the control unit 30 so that when this limit value is reached, a diverter 38 is activated by the control unit to divert the corresponding tube support member to the storage path 31.

The diverter 43 is also connected to the control unit 30, in order to actuate diversion of a tube support member 6 from the tube return path 11 if the reading device 24 has found a defect in the transfer means. This may for example be the case if the batch identification could not be found at one of the reading devices 22,23 and if the tube support member 6 has reached the tube return path 11 by the detour path 10. The reading device 24 then likewise ascertains the unfindable batch identification, as a result of which the diverters 43,46 are actuated by the control unit 30. This tube support member 6 accordingly is diverted to the storage path 31 as well.

The same is true for the information transfer means identified in the winding stations, if the delivery to the winding section was not done correctly for the particular batch.

The storage path 31 includes a first stopper 32, which may be actuated by the control unit 30 to reference tube support members. The control unit 30 communicates over a data line 30' with a computer terminal 26, which is typically used in automatic winding machines. This terminal also has a display 25. The storage path stopper 32 can also be administered from this terminal.

This opening of the stopper 32 can be limited in terms of time in such a way that only one tube support member 6 is let through and is then stopped at a second stopper 34 located downstream of the first stopper 32. A read/write memory device 33 is disposed in this position and may be connected to the information transfer means of the tube support member 6.

The information transfer means may be, as is known to those of skill in the art, an electrically readable, erasable and codable memory chip, which can come into contact with the read/write memory by a concentrically disposed antenna, regardless of the angular position of the tube support member. The memory chip may advantageously be interchangeably disposed in the tube support member, as described and shown for example in conjunction with the disposition of the antenna in German Patent Application DE 40 41 713 A1.

From the terminal 26, access to information by the read/write memory device 33 is accomplished, making it possible to conclude what is the cause of the diversion of this tube support member. For example, if no defect can be found in the information transfer means, the conclusion must unequivocally be that the diversion can be ascribed to an overly high number of circulations of the tube support member in the transport system without the yarn being completely removed. In that case, the human operator must look for the defect in the bobbin. However, it is also possible to call up the association from the control unit 30 which ascertained the exceeding of the limit value in terms of the number of recirculations. These limit values correspond to a certain memorized spinning station number and can be associated accordingly.

The other defects have to do with the memory chip, which should advantageously be replaced by a new one. In that case, the opening of the second stopper 34 is triggered from the terminal, causing the tube support member then to proceed to a terminal storage path 36. This terminal path should be formed in such a way that it is easy to remove the tube support members. This kind of out-transfer point is normally not provided in the rest of the transport system, because the tube support members constantly remain in the system. At that point, the introduction of a new tube support member or of the same tube support member with a replaced information transfer means can be performed.

A diverter 37, likewise actuatable via the terminal 26 and the control unit 30, is provided so that tube support members can be returned to normal circulation at a converging point 35 with the ancillary transport path 39 if out-transfer from the system is determined to be unnecessary. This tube support member then travels through the special preparation device 44 to the delivery path 7 at a converging point 45.

The possibility also exists, if the applicable electronic yarn clearer 20 in the winding station has detected considerable deficiencies of quality in the rewound yarn, of again writing information into the information transfer means of the tube support member 6 that is later defined as an abnormality and leads to the diversion of the tube support member, if a suitable yarn quantity is still contained on it. As a result, it is possible for this bobbin to be separated out, rather than being redelivered to a winding station and causing further quality deficiencies. Moreover, the corresponding spinning station can be detected, to enable intervention at that station by performing appropriate maintenance or repair.

The present invention assures that defective bobbins will be recognized and taken out of the loop without undue human intervention, to enable the performance of appropriate maintenance or removal. The present invention provides for removal of defective tube support members and bobbins by diverting them from the system. It is therefore possible by diverting these bobbins to overcome the deficiency by hand and return the transport unit to the transport system again. The multiple trips around the system can be recognized, for instance if the information transfer means of the tube support member carries the number of the spinning station that produced the bobbin being transported. This tube support member then repeatedly moves past the reading device at relatively short intervals. In normal operation, the reading device would not be able to ascertain the same spinning station number again until one complete doffing has taken place in the spinning machine, and a bobbin produced subsequently by the same spinning station has been unwound.

If the information carrier is not accommodated so that it is protected in a recess of the tube support member, it may become mechanically damaged, which can possibly make the stored data unreadable or may make it unusable. Such tube support member must be separated out, to prevent incorrect deliveries in multi-batch processing or incorrect information on the spinning station number. If an electronic memory chip is used as the information carrier, then the chip may optionally be replaced.

Although it will certainly be the exception if the batch information contained in the tube support member information carrier does not match the batch of the bobbin being transported, nevertheless the invention takes care of this case as well. If the yarn clearer in the winding station finds, over a certain yarn length, that the yarn weight is outside the set tolerance range or standard for the batch to be processed in that particular bobbin section, then the winding station must be stopped immediately. This can be accomplished via a threshold value switch on each winding station computer which can be activated if a tolerance is exceeded and which causes the immediate stoppage of the associated winding station. If it were not, a cross-wound package would be produced by the winding machine that includes deviant yarn for the length of yarn of one bobbin. Shutting off the winding station prevents this kind of major quality deficiency. By noting the deviation of the stored batch data in the information carrier from the data recognized by the yarn clearer, the transport unit is separated out in this case as well, so that the information carrier may be replaced if necessary.

Another embodiment, in which the yarn weight ascertained is compared with the yarn weight of the other batches stored in memory which may be associated with each winding station computer to be processed in the bobbin winder, makes it possible without human intervention to reprogram the information carrier by the writing means 19, and as a result the tube support member in the transport system can next be delivered to the appropriate winding section. Checking the newly written data means that another delivery to the wrong bobbin winding section can be prevented. The identification of the reprogramming that cannot be properly done for the applicable batch is likewise detected by the reading device at the point of divergence to the storage path. The inability to accomplish rewriting of the information may also be recorded. Hence this transport unit is likewise delivered to be repaired by the human operator.

By means of a further reading device disposed at the end of the storage path and coupled to the display device, the operator can directly detect the type of defect found. He can then take the appropriate steps required.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A textile winding machine having a transport system for recirculating bobbin tube support members carrying empty bobbins to, through, and from winding stations of the textile winding machine, and diverting tube support members carrying partially unwound bobbins, and tubes having remnant windings of yarn thereon into diverting paths, each bobbin having information transfer means carried thereon for containing data pertaining to the bobbin tube on which it is carried, wherein at least one reading means is present in the transport system for reading the information transfer means, said transport system comprising:

(a) a storage path for storing tube support members carrying bobbin tubes;

(b) means for diverting tube support members to said bobbin storage path; and (c) a control unit connected to the reading means for controlling said diverting means to divert tube support members or bobbins carried thereon to said storage path when predetermined storage path conditions are met as determined by said control unit in conjunction with this reading means.

2. The textile winding machine of claim 1, wherein the transport system includes a delivery path for delivering tube support members to the winding stations of the winding machines and a return path for returning tube support members from the winding stations, an ancillary transport path extending between said return path and said delivery path for transport of tube support members therebetween and said control device has a counting device for ascertaining multiple returns of the same tube support member, said counting device having a limit switch that is adjustable to a predetermined number of said multiple returns.

3. The textile winding machine of claim 2, wherein the information transfer means comprises a memory chip and a memory means coupled contactlessly to said chip by an associated antenna and further comprising counting means coupled to said memory means for writing bobbin data on the associated tube support member, said counting means disposed in an area for transferring bobbins to tube support members.

4. The textile winding machine of claim 1 wherein said control unit actuates the control of said diverting means in response to the inability to detect data of an information transfer means.

5. The textile winding machine of claim 1, further comprising:

winding sections of the winder for processing different batches of bobbins having yarn weights differing from one another;

at least one electronic yarn clearer, coupled to at least one winding station computer in the vicinity of the winding station having adjustable tolerance ranges for the correct yarn weight for a given batch;

a threshold value switch on each said at least one winding station computer that can be activated if a tolerance is exceeded and which causes the immediate stoppage of the winding station; and a writing means in each winding station for recording as an abnormality in the information transfer means of the bobbin the exceeding of the tolerance range by the yarn weight of the bobbin.

6. The textile winding machine of claim 5, wherein said at least one winding station computer is connected to a memory containing the tolerance ranges of the other batches prepared on the textile winder, in the form of data in memory for transmission to said writing means for writing the appropriate batch into the information transfer means of the tube support member; and wherein said writing means is a read/write memory device for monitoring the storage in memory of said batch data and to record any inability to accomplish said writing.

7. The textile winding machine of claim 1 wherein the textile winder is subdivided into winding sections for processing different batches with yarn weights differing from one another and further comprising:

branch paths branching from a common delivery path to the winding stations;

at least one diverter located in the vicinity of the beginning of said branch paths and each said diverter coupled to one second reading means for delivering the bobbins in correct batches; and a bypass path branching from said delivery path for transporting tube support members having information transfer means which are not legible by said second reading means.

8. The textile winding machine of claim 1 further comprising:

a third reading means coupled to a display means, said third reading means being disposed at said storage path for determining the type of defect of the tube support members or bobbins in said storage path.

* * * * *